United States Patent [19]

Grassmann

[11] 3,979,836

[45] Sept. 14, 1976

[54] METHOD AND APPARATUS FOR THE HIGH-FREQUENCY TREATMENT OF MOIST MATERIAL

[75] Inventor: Hans-Christian Grassmann, An den Eichen, Germany

[73] Assignee: Siemens Aktiengesellschaft, Munich, Germany

[22] Filed: Apr. 17, 1975

[21] Appl. No.: 568,862

[30] Foreign Application Priority Data

May 3, 1974 Germany ..... 2421570

[52] U.S. Cl. ..... 34/1; 219/10.81

[51] Int. Cl.[2] ..... F26B 3/34

[58] Field of Search ..... 34/1; 219/10.81; 62/62, 62/93; 236/12

[56] References Cited

UNITED STATES PATENTS 2,083,876 6/1937 Snediker ..... 236/12

2,428,615 10/1947 Brown ..... 34/1

FOREIGN PATENTS OR APPLICATIONS 699,082 10/1940 Germany ..... 34/1

965,760 6/1957 Germany

*Primary Examiner*—John J. Camby

*Assistant Examiner*—Larry I. Schwartz

*Attorney, Agent, or Firm*—Kenyon & Kenyon Reilly Carr & Chapin

[57] ABSTRACT

An apparatus and method are disclosed for preventing condensation of the steam produced during the high-frequency treatment of moist material. In particular, the aforesaid is brought about by heating and cooling at least the current leads and/or the electrodes of the apparatus in such a manner that prior to and during the r-f treatment the current leads and/or the electrodes have at least approximately the same surface temperature.

14 Claims, 1 Drawing Figure

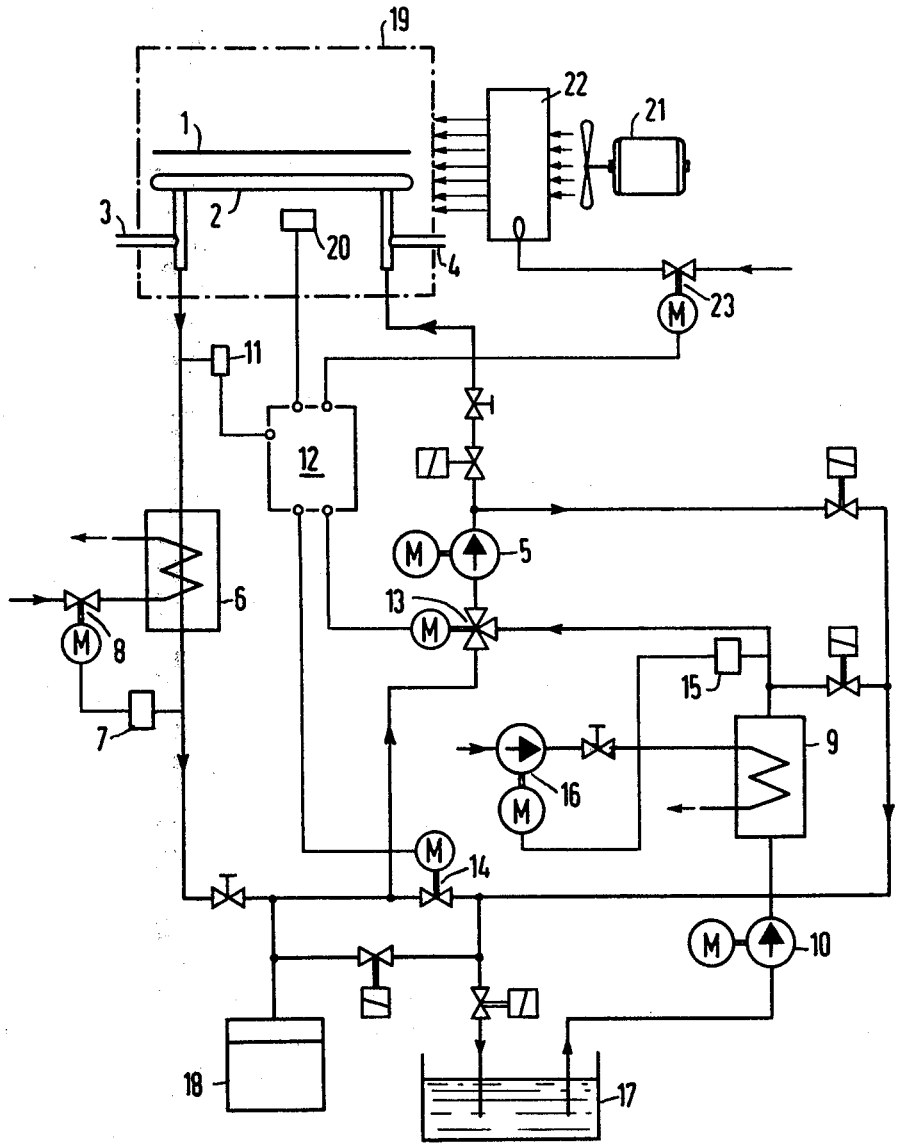
19
22
21
1
3
2
20
4
23
11
12
5
6
13
8
15
7
9
16
14
10
18
17

METHOD AND APPARATUS FOR THE HIGH-FREQUENCY TREATMENT OF MOIST MATERIAL

BACKGROUND OF THE INVENTION

1. Field of the Invention

The invention concerns a method and apparatus for the high-frequency treatment of moist material in which the material is disposed adjacent to and influenced by electrodes and a heat conductor is conveyed or run through the current leads serving the electrodes and, optionally, through the electrodes themselves.

2. Description of the Prior Art

Arrangements of the above-described type are known, for example, from German Pat. No. 965,760. In these known arrangments means are provided for cooling the current leads and the electrodes. However, nothing is employed in such arrangments to heat the current leads and the electrodes, although the latter procedure is known in and of itself (see German Pat. No. 699,082). Moreover, it has been found that the prior art arrangements do not prevent with certainty the steam leaving the material being treated from condensing in the treatment chamber. It is, therefore, an object of the present invention to provide a method and apparatus which produces the latter result.

SUMMARY OF THE INVENTION

In accordance with the principles of the present invention, the above and other objectives are realized, in the above-described type of method and apparatus, by providing that at least the current leads and/or the electrodes of the apparatus are heated prior to the start of the high-frequency treatment and are cooled during the high-frequency treatment in such a manner that during both operations the current leads and/or the electrodes have at least approximately the same surface temperature. In accomplishing the latter, is has been found advantageous to control the value of the current lead or electrode temperature as a function of the temperature and/or the moisture content of the ambient atmosphere. With such control, the temperature is prevented with certainty from falling below the dew point, while it is maintained at the lowest possible value which will keep mechanical stresses due to thermal expansion, as well as energy consumption, as low as possible. It has likewise been found advantageous to keep the heat carrier being conveyed under overpressure. As a result, water, for example, with its relatively high specific heat can be used as the heat carrier, while, at the same time, operating the apparatus above the water boiling point.

So that the method of the present invention can be implemented employing known technically proven equipment, it is a further advantage to control the flow rate of the heat carrier by a valve operated by a controller and/or the temperature of the heat carrier by a mixer, e.g., a three-way valve, operated by the controller. Additionally the temperature of the electrode chamber is maintained higher than the temperature of the heat carrier. This permits those parts of the electrodes and/or current leads which cannot be engaged fully by the heat carrier flowing therethrough to be heated to a temperature above the dew point. Moreover, in order to keep the temperature difference in the extended cooling and heating system as small as possible, the heat carrier is conducted through the pipeline system by means of at least one circulating pump.

BRIEF DESCRIPTION OF THE DRAWING

An illustrative embodiment of the invention will be discussed in the following detailed description which makes reference to the accompanying drawing in which:

The FIGURE shows apparatus in accordance with the principles of the present invention.

DETAILED DESCRIPTION

In FIG. 1, the material to be dried is in the form of a paper web 1 which is disposed adjacent to and in the garland-shaped r-f field of a set of electrodes, of which one electrode 2 is shown. The current leads 3 and 4, through which a heat carrier flows, are connected to the electrodes and to the terminals of the high-frequency generator, the latter not being shown in the drawing. Before the installation is put in operation, the circulating pump 5 of the electrode loop is switched on and steam, for instance, is admitted to the heat exchanger 6, so that the heat carrier, which in the illustrative case shown flows through the electrodes, is brought to the desired operating temperature of, say 90°C. As soon as the temperature sensor 7 registers the desired temperature of the heat carrier, the control valve 8 is closed automatically and the other equipment units, such as, for instance, the heat exchanger 9 including the circulation pump 10, are switched on. At this time, the electrode system and, thus, the entire installation, are ready for operation.

As can be appreciated, during the high-frequency operation of the installation, the electric losses produced in the electrode fields provide additional heating of the heat carrier. If such heating causes a temperature of, say 95°C, as measured by the temperature sensor 11, to be reached or exceeded, a signal from the temperature sensor 11 is fed to the controller 12. In response thereto, the latter actuates or opens, via intermediate members M, the three-way valve 13 and the through-valve 14. Opening the former valve causes colder heat carrier to be fed therethrough and into the electrode circulation from the cooling loop of the heat exchanger 9.

Moreover, the substantially simultaneous opening of the through valve 14 with the valve 13 prevents any overpressure which might result from colder heat carrier being supplied by valve 13 into the electrode loop. Thus, operation of the valves 13 and 14 causes the heat carrier circulating in the electrode loop to be held constant.

The heat carrier flowing through the through valve 14 heats up the circulation of the heat exchanger 9, whose operating temperature is about 25°C. If this value is exceeded, the temperature sensor 15 indicates the overtemperature and switches on the motor of the circulating pump 16, thereby causing fresh water of about 10°C to be pumped into the heat exchanger 9. As soon as the temperature falls below the operating temperature, the pump 16 is switched off, via the temperature sensor 15. Water supply tanks 17 are built into the loop from the heat exchanger 9, in order to compensate for any mass losses of the heat carrier which, for instance, might occur as a result of evaporation. Additionally, an underpressure tank 18 is also provided for equalizing the underpressure generated by the cooling down of the heat carrier after the electrode circulation is switched off.

A humidity sensor 20 for continuously monitoring the moisture content of the oven atmosphere during the drying process is arranged in the oven chamber 19. Use of the sensor 20 permits the oven temperature to be lower and, thus, energy for heating the oven intake air to be saved for drier types of paper. In particular, the oven intake air is fed into the oven chamber 19 by the blower 21, for instance, via a gas-heated register 22. The humidity sensor 20 feeds the actual humidity value to the controller 12 which actuates, in a conventional manner, via intermediate members M, the control valve 23, the latter valve being disposed in the heating gas feed line of the heating register 22.

The present invention is not intended to be limited to the illustrative embodiment shown, and is capable of being modified in many ways by those skilled in the art without departing from the spirit and scope of the invention. Thus, for instance, not only the electrodes of the capacitor of the treatment arrangement, but also any tuning inductances that may be required in the arrangment, may be connected to the controlled heat carrier loop. Similarly, induction coils can also be connected to the heat carrier loop instead of the capacitor electrodes, for the inductive heating of metallic objects.

What is claimed is:

1. A method for use in the high-frequency treatment of a moist material in which the material is influenced by electrodes which are connected to current leads through which a heat carrier flows comprising the steps of:

heating the current leads prior to the high-frequency treatment;

cooling the current leads during the high-frequency treatment;

controlling the current lead temperature as a function of the temperature of the ambient atmosphere; and said heating and cooling being carried out in such a manner that prior to said treatment and during said treatment the current leads are caused to have at least approximately the same surface temperature.

2. A method according to claim 1 which further includes the step of controlling the current lead temperature as a function of the moisture content of the ambient atmosphere.

3. A method in accordance with claim 1 further including the step of maintaining the heat carrier under overpressure.

4. A method for use in the high-frequency treatment of a moist material in which the material is influenced by electrodes which are connected to current leads through which a heat carrier flows comprising the steps of:

heating the current leads prior to the high-frequency treatment;

cooling the current leads during the high-frequency treatment;

controlling the electrode temperature as a function of the temperature of ambient atmosphere; and said heating and cooling being carried out in such a manner that prior to said treatment and during said treatment the current leads are caused to have at least approximately the same surface temperature.

5. A method according to claim 4 in which said heat carrier flows through said electrodes.

6. A method according to claim 4 which further includes the step of controlling the electrode temperature as a function of the moisture content of the ambient atmosphere.

7. A method according to claim 4 further including the step of maintaining the heat carrier under overpressure.

8. A method for use in the high-frequency treatment of a moist material in which the material is influenced by electrodes which are connected to current leads through which a heat carrier flows comprising the steps of:

heating the current leads prior to the high-frequency treatment;

cooling the current leads during the high-frequency treatment;

controlling the electrode temperature as a function of the temperature of ambient atmosphere; and said heating and cooling being carried out in such a manner that prior to said treatment and during said treatment said current leads are caused to have at least approximately the same surface temperature and in such a manner that prior to said treatment and during said treatment said electrodes are caused to have at least approximately the same surface temperature.

9. Apparatus for use in the high-frequency treatment of a moist material comprising:

electrodes for influencing said material;

a chamber for housing said electrodes;

current leads connected to said electrodes and adapted to carry a heat carrier therethrough;

a heat carrier passing through said current leads;

means for controlling the temperature of said heat carrier such that said current leads have at least approximately the same surface temperature prior to and during said high-frequency treatment, said means for controlling including a mixer and a controller for actuating said mixer; and means for controlling the temperature of said chamber such that it is higher than the temperature of said heat carrier.

10. Apparatus in accordance with claim 9 in which said mixer is a three-way valve.

11. Apparatus in accordance with claim 9 which further includes:

a pipeline for conducting said heat carrier to and from said current leads;

and at least one circulating pump for pumping said heat carrier through said pipeline.

12. Apparatus for use in the high-frequency treatment of a moist material comprising:

electrodes for influencing said material;

a chamber for housing said electrodes;

current leads connected to said electrodes and adapted to carry a heat carrier therethrough;

a heat carrier passing through said current leads;

means for controlling the flow rate of said heat carrier such that said current leads have at least approximately the same surface temperature prior to and during said high-frequency treatment, said means for controlling including a valve and a controller for actuating said valve; and means for controlling the temperature of said chamber such that it is higher than the temperature of said heat carrier.

13. Apparatus for use in the high-frequency treatment of a moist material comprising:

electrodes for influencing said material, said electrodes being adapted to carry a heat carrier therethrough;

a chamber for housing said electrodes;

current leads connected to said electrodes and adapted to carry said heat carrier therethrough;

a heat carrier passing through said electrodes and current leads;

means for controlling the temperature of said heat carrier such that said electrodes have at least approximately the same surface temperature prior to and during said high-frequency treatment, said means for controlling including a mixer and a controller for actuating said mixer; and means for controlling the temperature of said chamber such that it is higher than the temperature of said heat carrier.

14. Apparatus for use in the high-frequency treatment of a moist material comprising:

electrodes for influencing said material, said electrodes being adapted to carry a heat carrier therethrough;

a chamber for housing said electrodes;

current leads connected to said electrodes and adapted to carry said heat carrier therethrough;

a heat carrier passing through said electrodes and current leads;

means for controlling the flow rate of said heat carrier such that said electrodes have at least approximately the same surface temperature prior to and during said high-frequency treatment, said means for controlling including a valve and a controller for actuating said value; and means for controlling the temperature of said chamber such that it is higher than the temperature of said hear carrier.

* * * * *